US006628915B2

(12) United States Patent
Muramatsu et al.

(10) Patent No.: US 6,628,915 B2
(45) Date of Patent: Sep. 30, 2003

(54) DEVELOPER CONTAINER FOR AN IMAGE FORMING APPARATUS

(75) Inventors: Satoshi Muramatsu, Tokyo (JP); Junichi Matsumoto, Kanagawa (JP); Nobuo Kasahara, Kanagawa (JP); Nobuo Iwata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/281,250

(22) Filed: Oct. 28, 2002

(65) Prior Publication Data

US 2003/0081969 A1 May 1, 2003

(30) Foreign Application Priority Data

Oct. 30, 2001 (JP) ..... 2001-333225
Oct. 8, 2002 (JP) ..... 2002-295295

(51) Int. Cl.[7] ..... G03G 15/08
(52) U.S. Cl. ..... 399/258
(58) Field of Search ..... 399/258, 259, 399/260, 261, 262, 106, 254, 263; 222/DIG. 1

(56) References Cited

U.S. PATENT DOCUMENTS 4,937,625 A * 6/1990 Kato et al. ..... 399/258
5,875,380 A 2/1999 Iwata et al.
5,953,567 A 9/1999 Muramatsu et al.
5,983,059 A * 11/1999 Oka et al. ..... 399/262
5,987,298 A 11/1999 Muramatsu et al.
6,112,046 A 8/2000 Suzuki et al.
6,128,459 A 10/2000 Iwata et al.
6,142,690 A 11/2000 Yoshimura et al.
6,163,669 A 12/2000 Aoki et al.
6,201,941 B1 3/2001 Kasahara et al.
6,282,396 B1 8/2001 Iwata et al.
6,295,437 B1 9/2001 Hodoshima et al.
6,381,435 B2 4/2002 Shinohara et al.
6,393,241 B1 * 5/2002 Matsumoto et al. ..... 399/258
6,507,720 B2 1/2003 Kabumoto et al.
6,526,246 B2 * 2/2003 Iwata et al. ..... 399/258
2001/0021326 A1 * 9/2001 Yanagisawa et al. ..... 399/258
2001/0036666 A1 * 11/2001 Sahashi
2001/0041083 A1 * 11/2001 Terazawa et al. ..... 399/258
2001/0052526 A1 * 12/2001 Kasahara et al. ..... 399/258
2002/0025196 A1 * 2/2002 Matsumoto et al. ..... 399/258

FOREIGN PATENT DOCUMENTS

JP 2001-100506 * 4/2001
JP 2001-166581 * 6/2001
JP 2002132028 A * 5/2002 ..... G03G/15/08

* cited by examiner

*Primary Examiner*—Susan S. Y. Lee
*Assistant Examiner*—Ryan Gleitz
(74) *Attorney, Agent, or Firm*—Oblon, Spivak, McClelland, Maier & Neustadt, P.C.

(57) ABSTRACT

A developer container storing a developer of the present invention includes a developer outlet formed in the side wall thereof, and a shutter member for selectively opening or closing the developer outlet. The shutter member opens the developer outlet when the developer container is mounted to the body of an image forming apparatus or closes it when the former is dismounted from the latter. The toner container with this configuration surely prevents the developer from leaking when the developer container is dismounted from an image forming apparatus.

7 Claims, 15 Drawing Sheets

DEVELOPER CONTAINER FOR AN IMAGE FORMING APPARATUS

BACKGROUND OF THE INVENTION

1. Field of the Invention

The present invention relates to a developer container for use in an image forming apparatus and storing a developer to be replenished to the image forming apparatus.

2. Description of the Background Art

A predominant type of developing device for use in a copier, facsimile apparatus or similar electrophotographic image forming apparatus uses a two-ingredient type developer, i.e., a toner and carrier mixture. In this type of developing device, toner contained in the developer is consumed little by little due to repeated image formation, so that fresh toner must be replenished to the developing device at adequate timing. For this purpose, a toner bottle, toner cartridge or similar toner container packed with fresh toner is removably mounted to the image forming apparatus for replenishing the toner to the developing device.

To replenish toner from the toner container to the developing device, use has customarily been made of mechanical auger means that allows the amount of toner conveyance to be controlled. However, a problem with auger means is that it is applicable only to a substantially straight conveyance path. Another problem is that if the conveyance path is long, the quality of toner is lowered due to, e.g., cohesion. It is therefore necessary to locate the toner container in the vicinity of the developing device. Further, auger means cannot lift toner at an acute angle even if the conveyance path is short, so that the toner container must be positioned at a higher level than the developing device.

Japanese Patent Laid-Open Publication Nos. 2002-139902 and 2001-166581, for example, teach toner replenishing devices configured to solve the above problems. However, the devices taught in these documents have a drawback that a developer leaks when a toner container is removed after use and a drawback that much toner is left in the removed toner container.

Technologies relating to the present invention are also disclosed in, e.g., Japanese Patent Laid-Open Publication No. 2001-100506.

SUMMARY OF THE INVENTION

It is an object of the present invention to provide a toner container for an image forming apparatus capable of surely obviating the leak of toner when it is removed after use and allowing a minimum of toner to be left therein.

In accordance with the present invention, a developer container storing a developer includes a developer outlet formed in the side wall thereof, and a shutter member for selectively opening or closing the developer outlet. The shutter member opens the developer outlet when the developer container is mounted to the body of an image forming apparatus or closes it when the former is dismounted from the latter.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
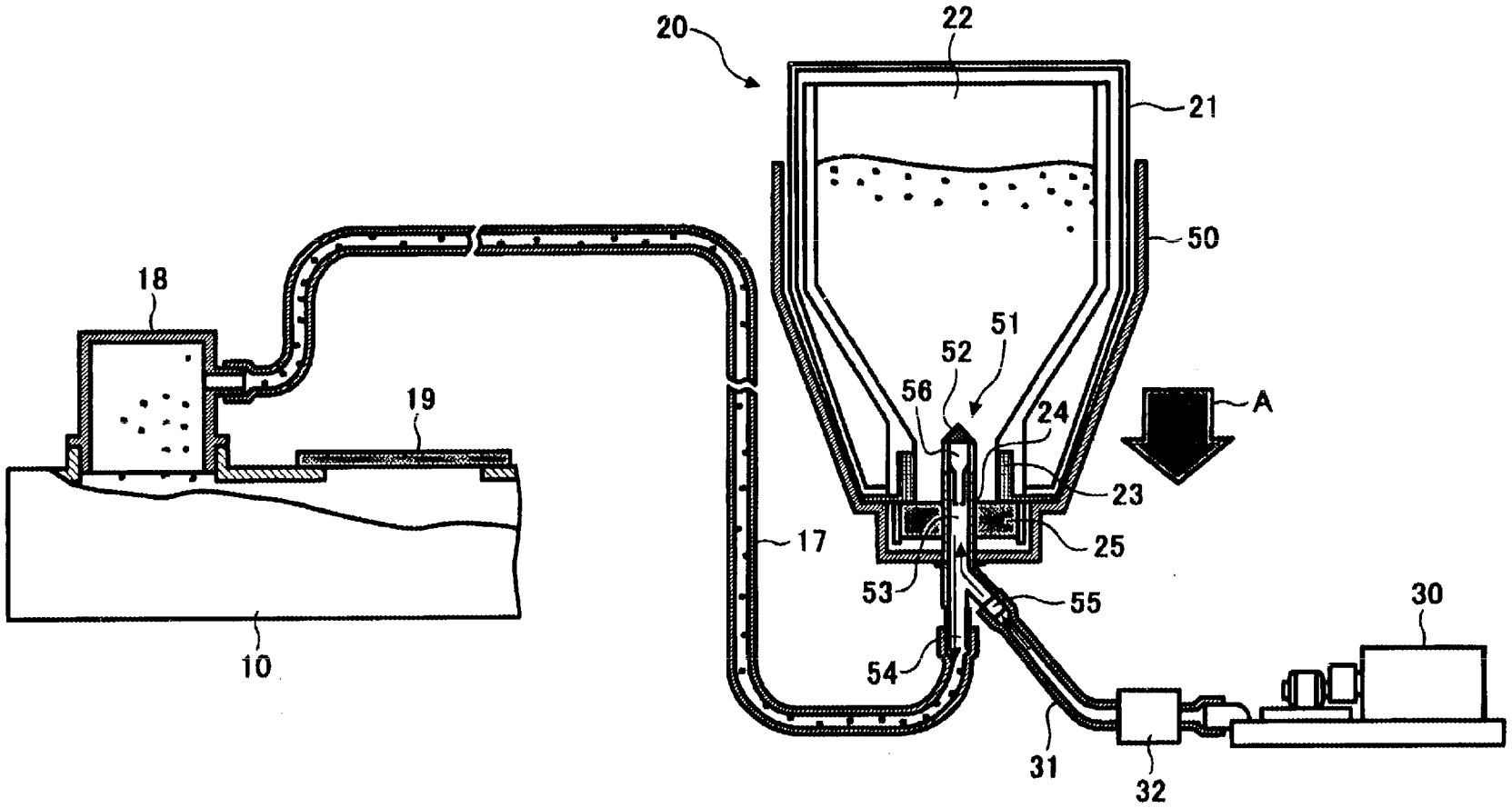
FIG. 1 PRIOR ART
FIG. 1 is a section showing a conventional toner replenishing device.

To better understand the present invention, reference will be made to a conventional toner replenishing device disclosed in Japanese Patent Laid-Open Publication No. 2002-139902 mentioned earlier, shown in FIG. 1. As shown, the toner replenishing device includes a mount portion 50 implemented by part of the body of an image forming apparatus. A toner container or developer storing means 20 is removably mounted to the mount portion 50.

A nozzle 51 extends substantially upright from the mount portion 50 and plays the role of an engaging member capable of penetrating into the toner container 20. Having a linear, tubular configuration, the nozzle 51 is formed integrally with the mount portion 50 or is removably fitted thereon at a preselected position. A tip portion 52 is formed on the top of the nozzle 51 and provided with a conical or a circular section. A passage 53 contiguous with the tip portion 52 extends throughout the nozzle 51 and bifunctions as an air passage and a toner passage.

A tube 17 provides fluid communication between the passage 53 and a developing device 10. More specifically, the tube 17 is connected at one end to a toner outlet 54 formed at the bottom of the nozzle 51 and connected at the other end to a toner inlet 18 included in the developing device 10. An air inlet 55 branches off the passageway 53 at a position above the toner outlet 54 and extends rightward, downward, as viewed in FIG. 1. An opening 56 adjoins the tip portion 52 of the nozzle 51 and is configured to receive toner and discharge air at the same time.

The tube 17 is a flexible tube having a diameter of, e.g., 4 mm to 10 mm and preferably formed of rubber highly resistant to toner, e.g., polyurethane rubber, nitril rubber or silicone rubber. Such a flexible tube can be easily arranged in the up-and-down direction or the right-and-left direction, as desired. A tube 31 provides fluid communication between the air inlet 55 and an air pump or air feeding means 30 and includes a valve 32 that is selectively opened or closed by an electric signal. In this configuration, air under pressure is delivered from the air pump 30 to the toner container 20 via the tube 31, air inlet 55, and passage 53.

The toner container 20 has a bag-in-box type of configuration made up of a box or protection case 21 and a flexible, deformable bag or sack 22 removably received in the box 21. The box 21 is formed of paper, corrugated cardboard, resin or similar relatively rigid material and has a space capable of accommodating the bag 22 without any substantial clearance. The bag 21 not only protects the flexible bag 22, which stores toner, but also promotes easy handling and neat storage of the toner container 20.

Figure 2B:
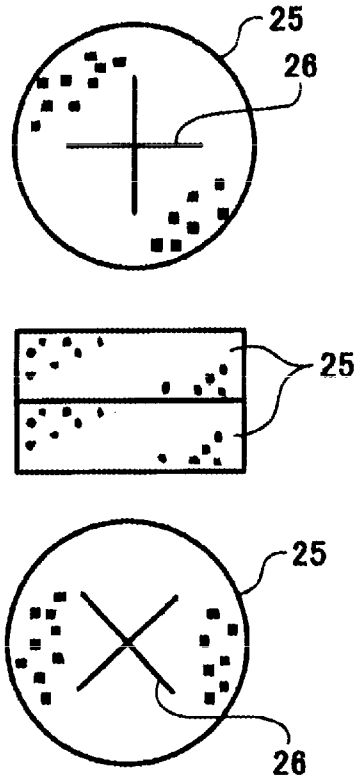
FIG. 2B PRIOR ART
FIGS. 2A and 2B each show a particular configuration of shutter means included in the device of FIG. 1.
Figure 2A:
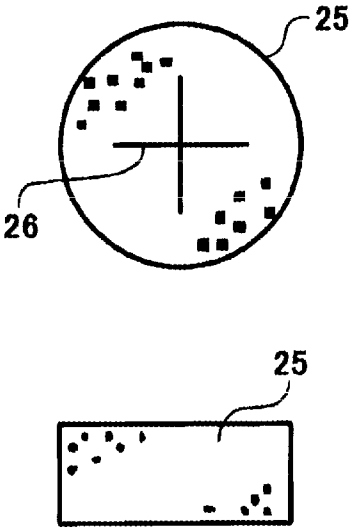
FIG. 2A PRIOR ART

The bag 22 is implemented by a polyester film, a polyethylene film or similar flexible sheet (80 $\mu$m to 125 $\mu$m thick) or a laminate of such sheets. A toner outlet 24 is formed in the bottom center of the bag 22 while a mouth member 23 formed of polyethylene, nylon or similar resin is affixed to the toner outlet 24. A seal valve or self-closing valve 25 is fitted in the mouth member 23 and may have a single layer, as shown in FIG. 2A, or two or more layers, as shown in FIG. 2B. The seal valve 25 is formed of foam sponge or similar elastic material nonpermeable to air and is formed with a cruciform slit 26. Further, the seal valve 25 is tapered toward the toner outlet 24, so that a minimum of toner is left in the bag 22.

In operation, compressed air delivered from the air pump 30 jets into the toner container 20 via the tube 31 and the air passage 53 of the nozzle 51. The resulting steam of air flows through the toner layer in the bag 22 while scattering it, thereby fluidizing the toner. At the same time, pressure inside the bag 22 rises with the result that a pressure difference occurs between the toner container 20 and the developing device 10 (atmospheric pressure), causing the fluidized toner to flow toward the developing device 10. In this manner, the toner is replenished from the toner container 20 to the developing device 10 via the tube 17. When the air pump 30 stops delivering compressed air, the valve 32 in the tube 31 is closed to prevent the nozzle from reversely flowing from the passage 53 to the air pump 30 via the nozzle 51.

As stated above, the conventional toner replenishing device fluidizes the toner with air and conveys it to a desired position on the basis of a pressure difference. It is therefore necessary to surely fluidize the toner around the tip portion 52 of the nozzle 51 and to maintain the passage extending from the toner container 20 to the tube 17 fully hermetic. The developing device 10 additionally includes a filter 19 that passes air, but does not pass the toner. The filter 19 therefore discharges only air contained in the toner to the outside of the developing device 10.

The lower portion of the bag 22 is funnel-shaped, i.e., tapered toward the toner outlet 24, so that the toner inside the bag 22 can be discharged without remaining in the bag 22. Further, the bag 22 is continuously filled with air fed from the air pump 30 and therefore free from creases or folds, so that frictional resistance ascribable to the walls of the bag 22 is reduced. Consequently, the toner inside the bag 22 is free from mechanical stresses and fluidized by air and is therefore prevented from cohering or bridging. This allows the property of the toner to remain stable.

Figure 3:
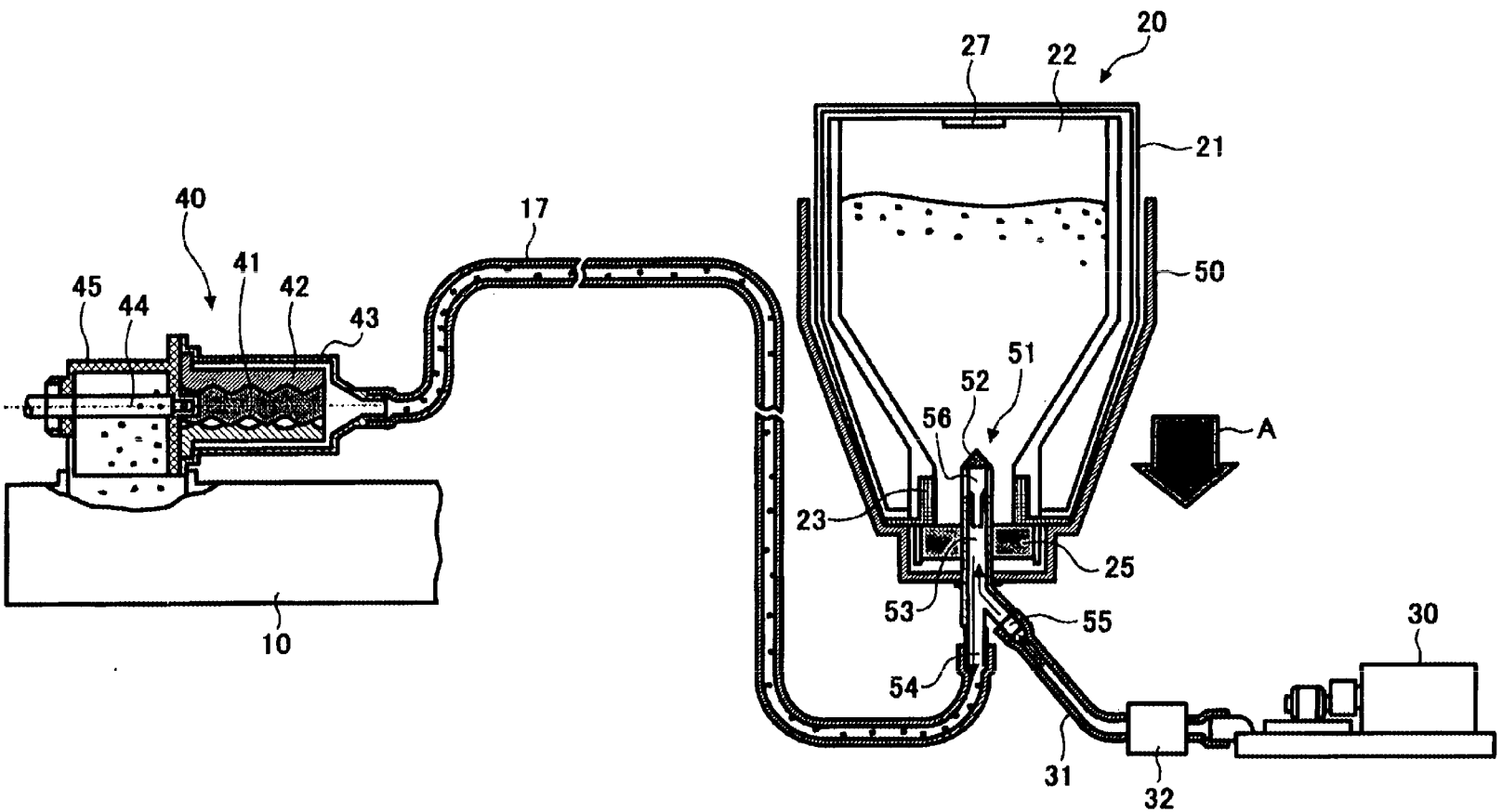
FIG. 3 PRIOR ART
FIG. 3 is a section showing another conventional toner replenishing device.

FIG. 3 shows another conventional toner replenishing device taught in Japanese Patent Laid-Open Publication No. 2001-166581 also mentioned earlier. This toner replenishing device is identical with the toner replenishing device described above as to the mount portion 50, nozzle 51, and air pump 30. In FIG. 3, structural elements identical with the structural elements shown in FIG. 1 are designated by identical reference numerals and will not be described specifically in order to avoid redundancy.

As shown in FIG. 3, the tube 20 connects the nozzle 51 to a powder pump 40, which is a single-axis screw pump, that sucks the toner out of the toner container 20. The powder pump 40 is generally made up of a female-screw type stator 42 formed of rubber or similar elastic material and a male-screw type rotor 41 formed of metal or resin. The stator 42 is formed with a double-pitch spiral groove. The rotor 41 is affixed to a drive shaft 44 by, e.g., a spring pin and caused to rotate via the drive shaft 44. A holder 43 is affixed to a case 45 and surrounds the stator 42 with the intermediary of a gap. A filter 27 is fitted on the top of the bag 27 so as to discharge air delivered from the air pump 30 to the toner container 20.

Figure 4:
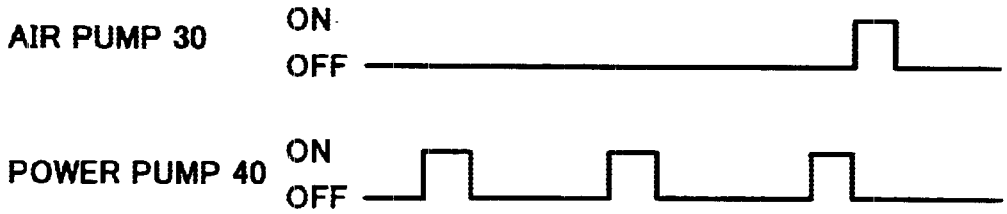
FIG. 4 PRIOR ART
FIG. 4 is a timing chart demonstrating the operation of an air pump and a powder pump included in a toner replenishing system particular to the device of FIG. 3.

FIG. 4 is a timing chart demonstrating control over the air pump 30 and powder pump 40 shown in FIG. 3. As shown, after the air pump 30 has been driven over a preselected total period of time, the air pump 30 is driven over a preselected period of time. More specifically, after a preselected amount of toner has been delivered from the toner container 20, air is fed into the toner container 20 for allowing the entire toner to be delivered without bridging inside the container 20.

The toner sucked into the powder pump 40 is dropped into the developing device 10. When use is made of a toner and carrier mixture, the toner dropped into the developing device 10 is mixed with a developer existing in the device 10 while being agitated together with the developer. This allows the developer to maintain a constant toner content and an adequate amount of charge.

The arrangement shown in FIG. 3 also frees the toner from mechanical stresses and fluidizes the toner with air for thereby obviating cohesion and bridging of the toner. In addition, the toner container 20 can be positioned at any desired position without regard to the position of the developing device 10.

In both of the conventional toner replenishing devices described above, the operator should only drop the toner container 20 into the mount portion 50 in the direction of gravity. The nozzle 51 automatically penetrates into the toner container 20 dropped into the mount portion 50, causing the toner outlet to open. When the operator simply picks up the toner container 20 out of the mount portion 50, the toner outlet automatically closes. More specifically, the seal valve 25 deforms to open the toner outlet when the nozzle 51 penetrates into the center of the cruciform slit 26 of the seal valve 25 or restores its original position when the toner container 20 is picked up, thereby preventing the toner from leaking.

However, the restoring force of sponge, which constitutes the seal valve 25, is apt to decrease due to, e.g., creep deformation. Because the slit 26 of the seal valve 25 extends in the direction of gravity, a decrease in the restoring force of the sponge causes the toner to leak through the slit until the slit 26 fully closes.

Figure 5:
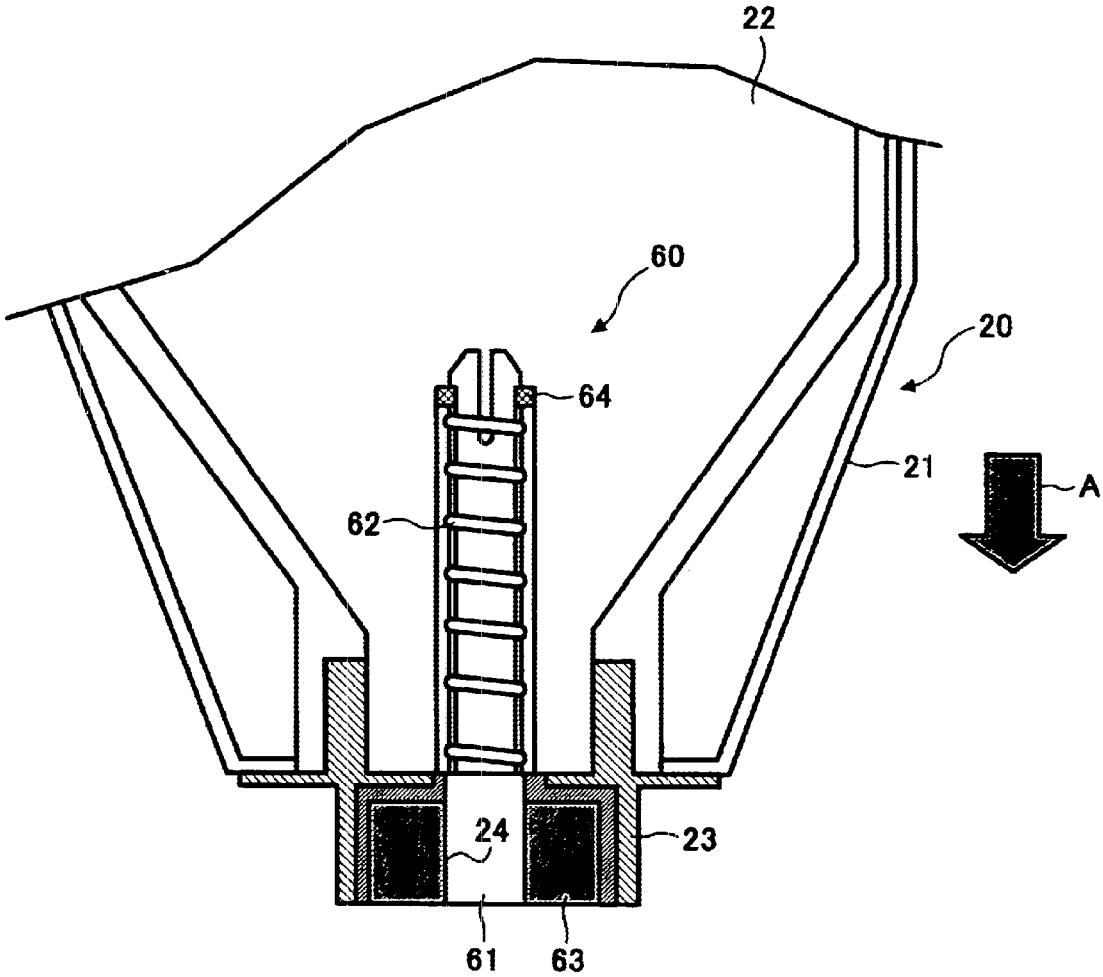
FIG. 5 PRIOR ART
FIG. 5 is a section showing a conventional toner container.

FIG. 5 shows a conventional toner container configured to solve the above problem. As shown, the toner container, also labeled 20, includes an inside shutter 60 in place of the seal valve 25. The inside shutter 60 is configured integrally with the mouth member 23 and made up of a shutter member 61, a compression spring 62, an annular seal member 63, and a spring seat 64. The spring 62 constantly biases the shutter member 61 downward. The shutter member 61 therefore remains in contact with the seal member 63 for thereby hermetically closing the toner outlet of the toner container.

Figure 6:
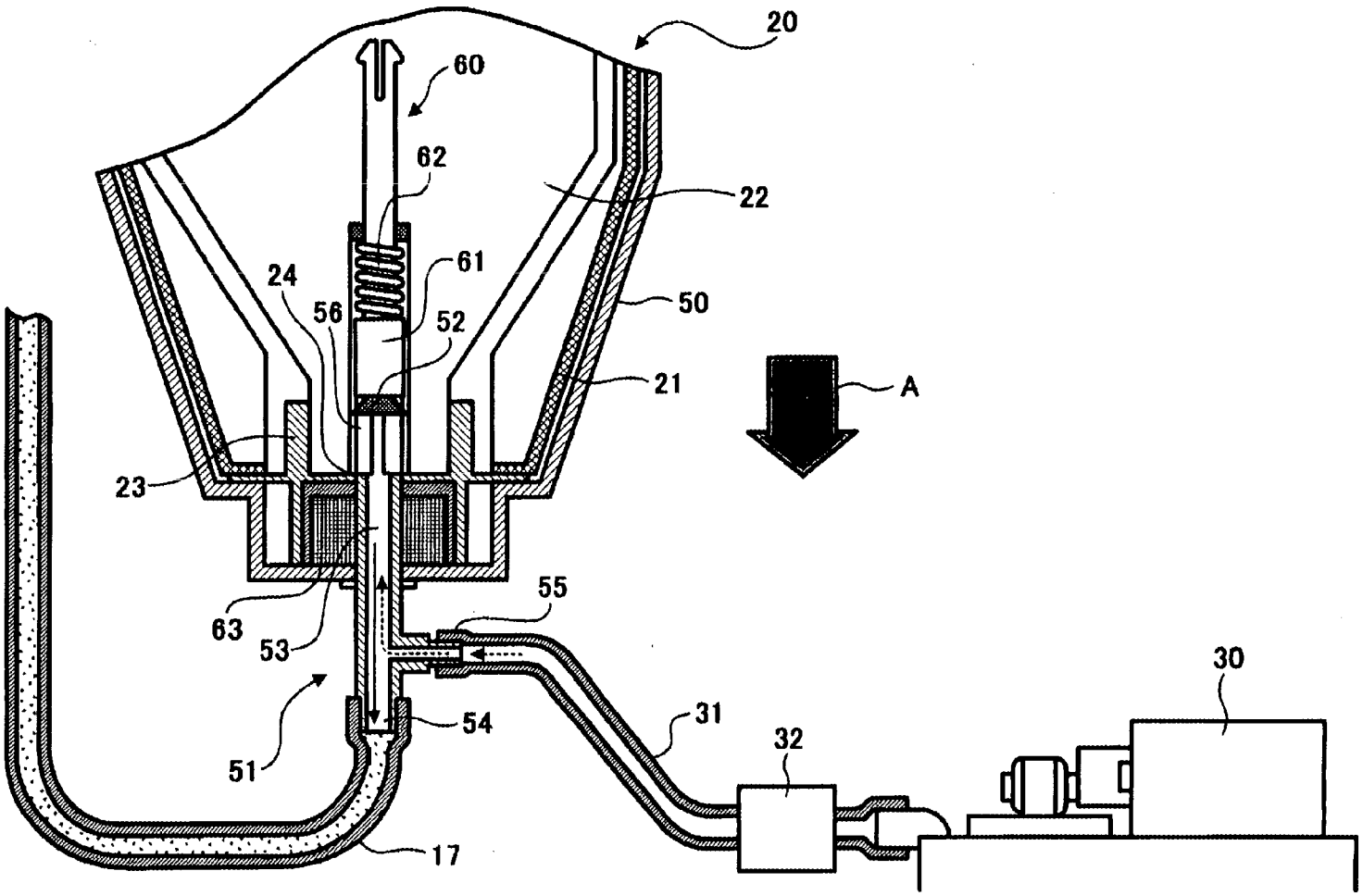
FIG. 6 PRIOR ART
FIG. 6 is a section showing the toner container of FIG. 5 in a set position.

As shown in FIG. 6, when the toner container 20 is dropped into the mount portion 50 in a direction A, the nozzle 51 penetrates into the toner container 20 while pushing the shutter member 61 upward. As a result, a toner passage is formed in the same manner as in FIGS. 1 and 3. When the toner container 20 is picked up in the direction opposite to the direction A, the shutter member 61 returns to its original position in contact with the nozzle 51 due to the bias of the spring 62, thereby causing a minimum of toner to leak.

However, the toner container 20 shown in FIGS. 5 and 6 has the following problems left unsolved. The inside shutter 60 is positioned above the nozzle 51 when the toner container 20 is set in the mount portion 50. The inside shutter 60 therefore obstructs the discharge of the toner from the toner container 20 and causes the toner to easily bridge inside the container 20. Even air fed into the toner container 20 for loosening the bridged toner cannot easily loosen the toner above the inside shutter 60. Consequently, the toner cannot be stably replenished and is left in the toner container 20 in an extremely great amount. Moreover, the toner is discharged in the direction in which the toner container 20 is dismounted, some toner leaks from the container 20 even if the inside shutter 60 instantly closes. In addition, if the closing of the inside shutter 60 is accidentally delayed, the toner leaked from the toner container 20 smears the mount portion 50.

Figure 7:
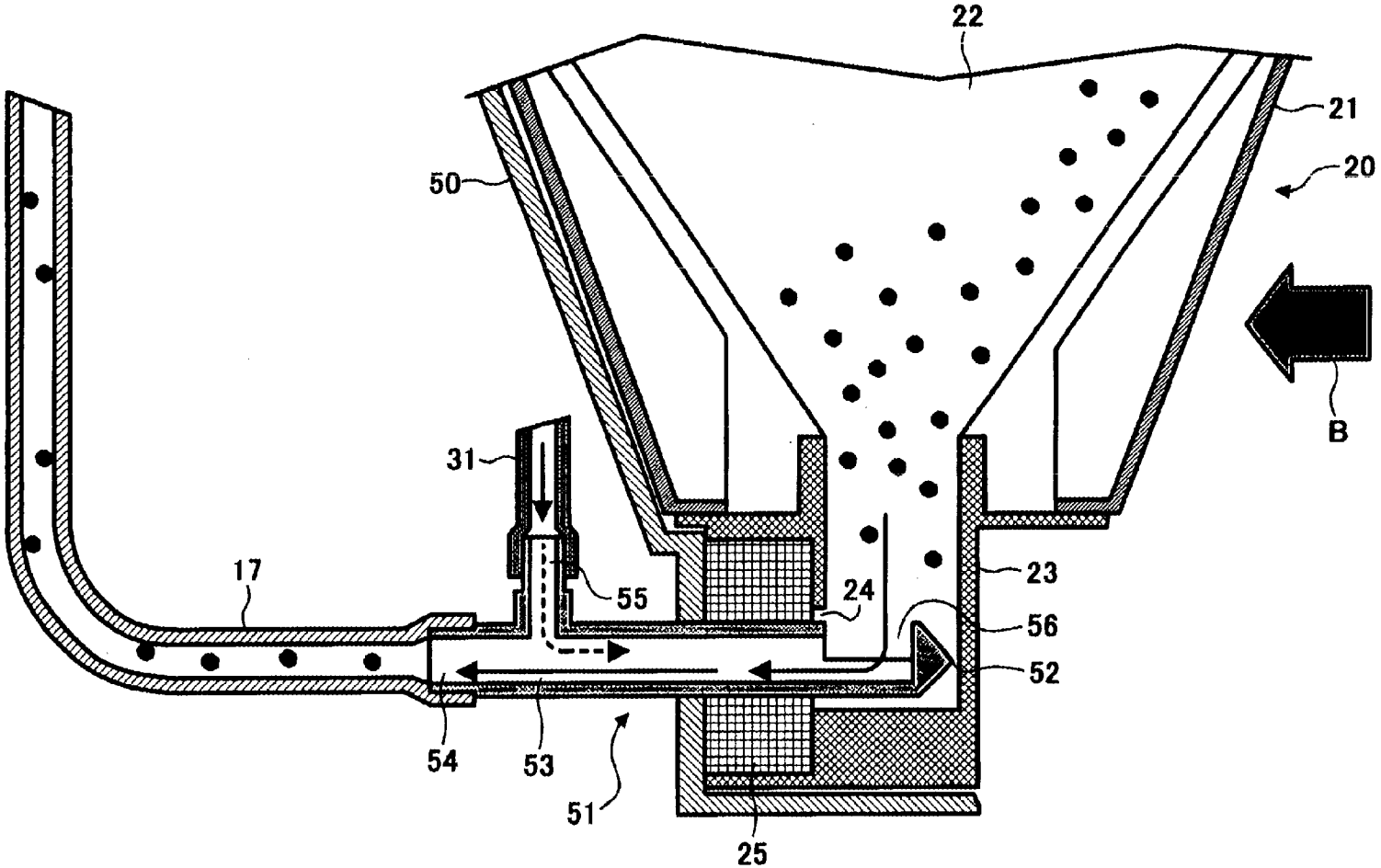
FIG. 7 is a fragmentary section showing a toner container embodying the present invention.

Referring to FIG. 7 of the drawings, a toner container or developer container embodying the present invention will be described. The illustrative embodiment also uses the toner replenishing system described with reference to FIGS. 1 and 3, although not shown specifically. As shown, a toner outlet 24 is formed in the lowermost portion of a toner container 20 as in the configuration of FIG. 1 or 3, but is formed in the side wall of the container 20 that faces sideways in substantially the horizontal direction when the container 20 is set in a mount portion 50. A toner outlet 24 is formed in a mouth member 23.

Figure 8:
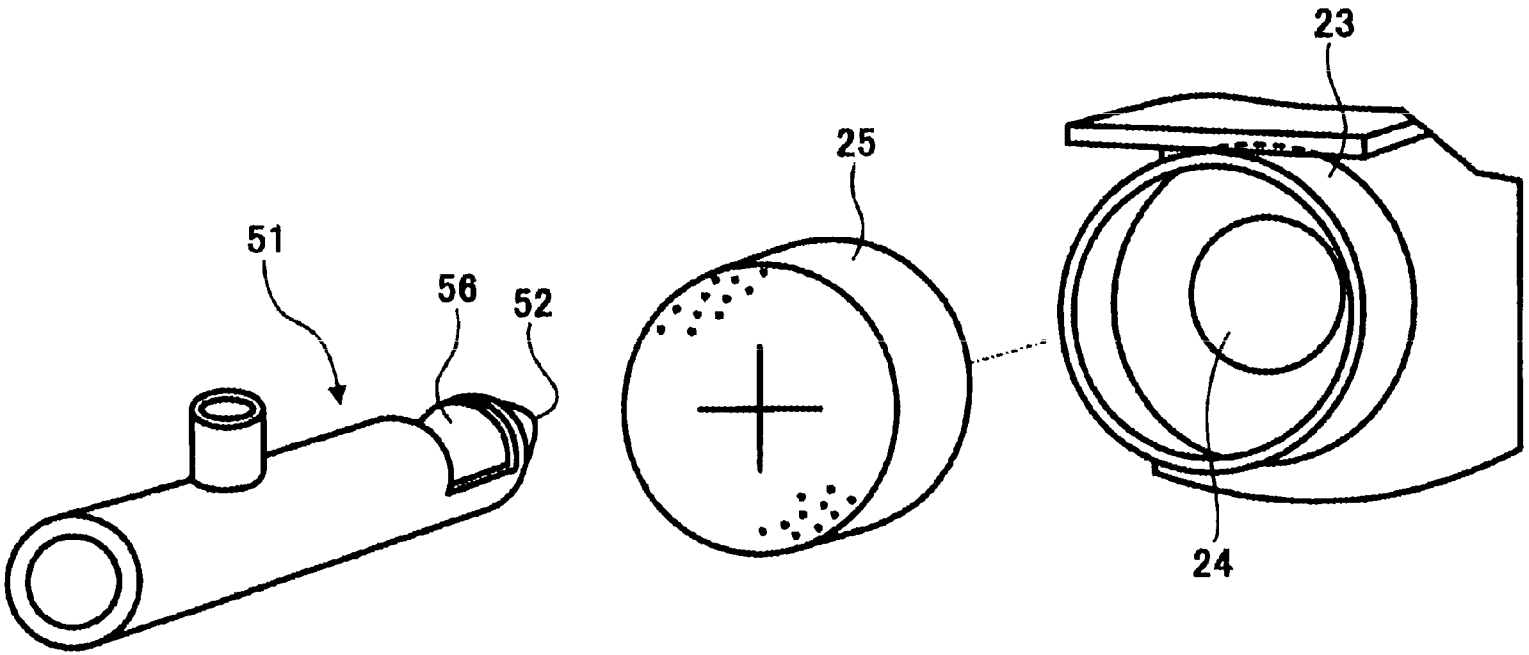
FIG. 8 is an exploded perspective view showing a toner outlet portion forming part of the illustrative embodiment.

As shown in FIGS. 7 and 8, the seal valve 25 shown in FIG. 2A or 2B is fitted in the mouth member 23 sideways. Further, a nozzle 51 included in the mount portion 50 differs from the nozzle 51 of FIG. 1 or 3 in that the axis of the former is shifted from the axis of the latter by 90° and extends in substantially the horizontal direction. In addition, an opening 56 formed in the nozzle 51 faces upward.

In the illustrative embodiment, the toner container 20 is mounted to the mount portion 50 in substantially the horizontal direction, as indicated by an arrow B in FIG. 7. At this instant, the substantially horizontal nozzle 51 penetrates into the toner container 20. In this manner, the operator can set the toner container 20 with a single action. Consequently, a hermetic passage extending from the toner container 20 to the developing device 10, not shown, is set up in the same manner as in FIG. 1 or 3. Further, because the nozzle 51 is horizontal, the space occupied by the nozzle 51 and tube 17 in FIG. 1 or 3 is reduced, making the toner replenishing device compact.

When the operator pulls out the toner container 20 in the direction opposite to the direction B, the nozzle 51 is released from the container 20. At this instant, hardly any toner drops from the toner container 50 even if the slit 26 of the seal valve 25 does not instantly restore its original shape, because the slit 26 faces sideways.

As stated above, the illustrative embodiment prevents, when the toner container 20 is pulled out of the mount portion 50, the toner from dropping simply by forming the toner outlet 24 in the side wall of the toner container 20.

Figure 9:
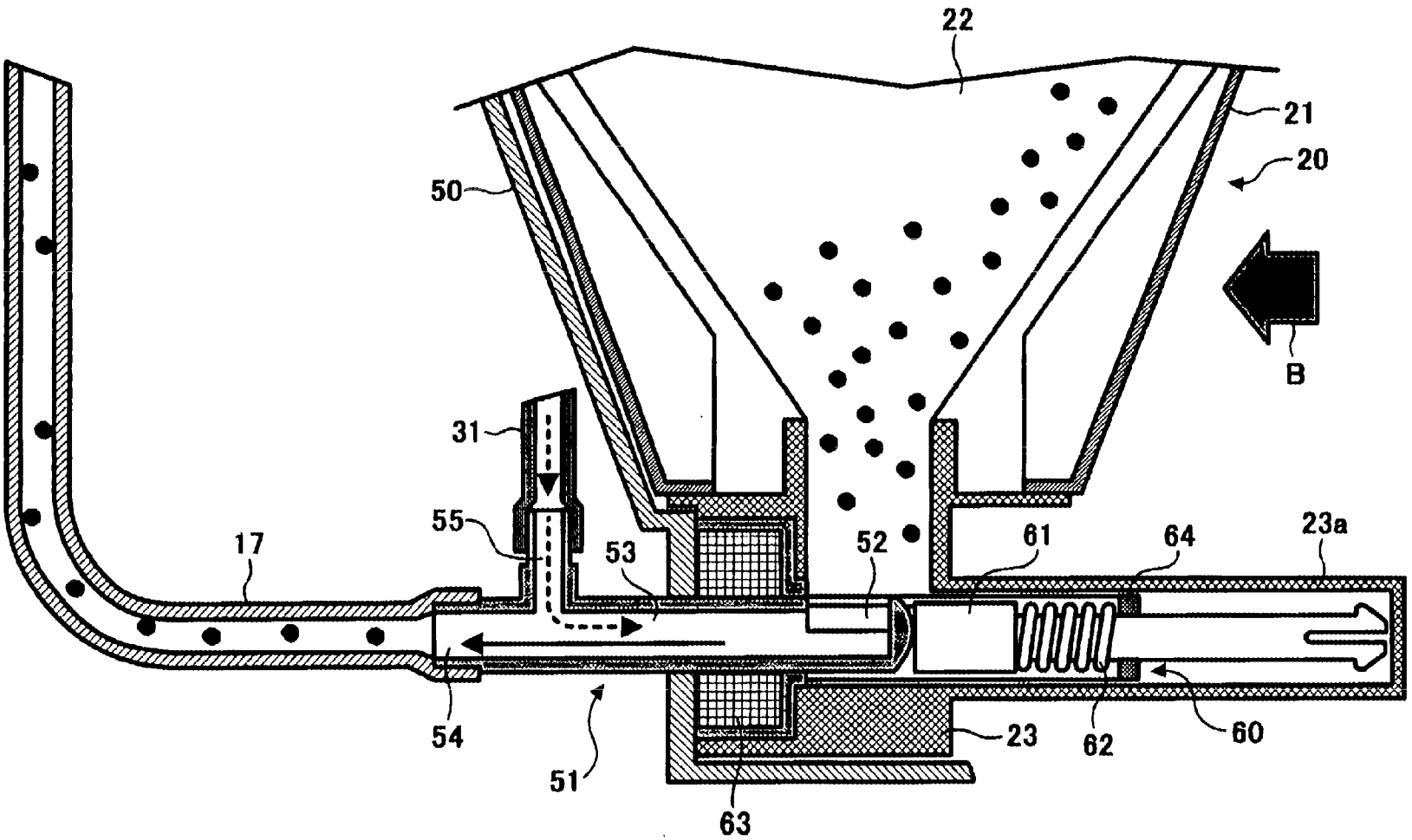
FIG. 9 is a fragmentary section showing an alternative embodiment of the present invention.
Figure 10:
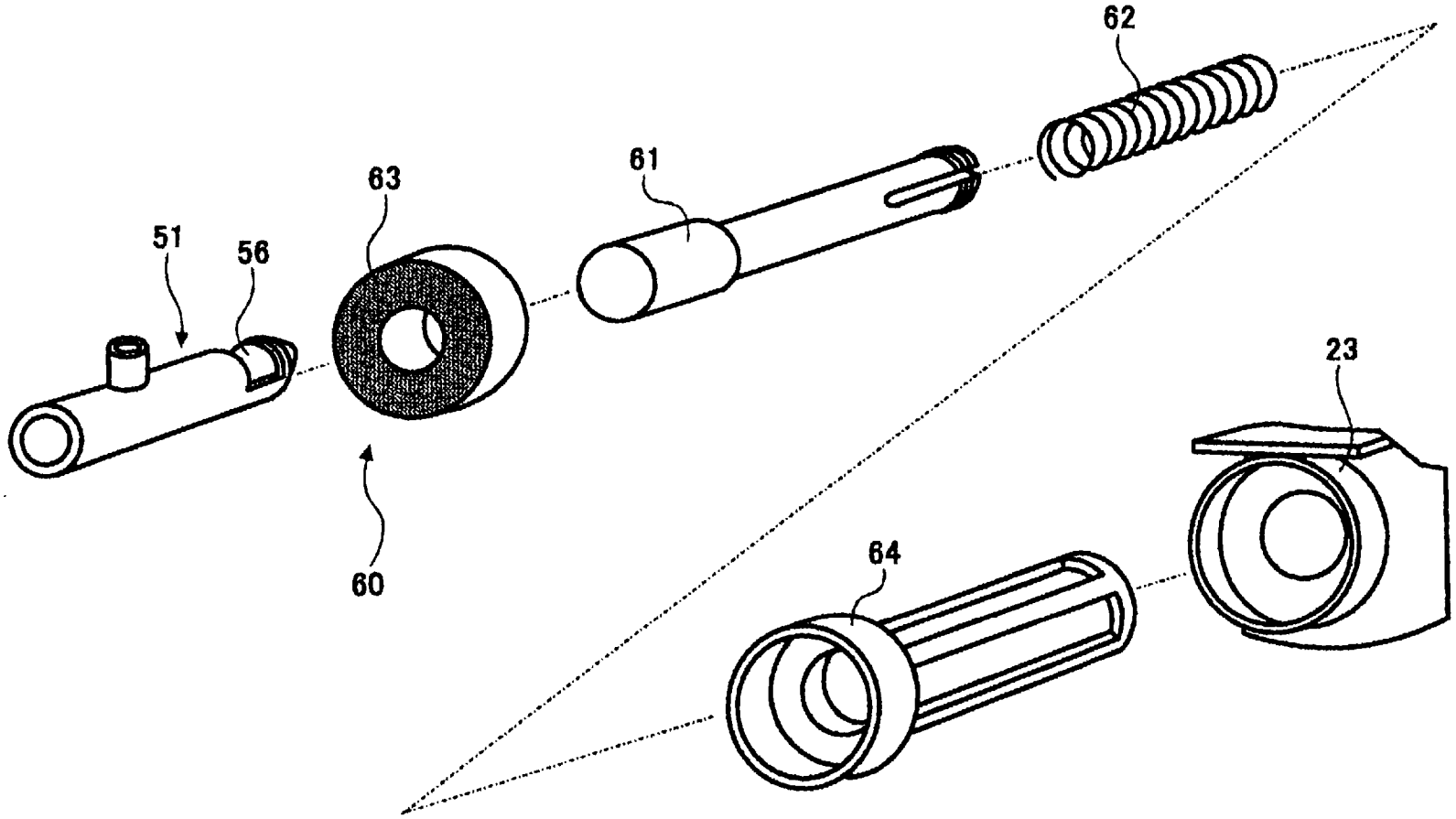
FIG. 10 is an exploded perspective view showing a toner outlet portion included in the embodiment of FIG. 9.

Reference will be made to FIGS. 9 and 10 for describing an alternative embodiment of the present invention. As shown, the toner container 20 includes the inside shutter 60 described with reference to FIG. 5. The shutter member 61, spring 62 and spring seat 64 constituting the inside shutter 60 will not be described specifically in order to avoid redundancy. A horizontal opening 23*a* is formed in the mouth member 23 in order to receive the shutter member 61.

When the toner container 20 is mounted to the mount portion 50 in the direction B, i.e., in substantially horizontal direction, the nozzle 51 with a horizontal axis penetrates into the container 20 and opens the inside shutter 60. As a result, a hermetic passage extending from the toner container 20 to the developing device 10, not shown, is set up, allowing the toner to be replenished from the container 20 to the developing device 10.

When the toner container 20 is pulled out in the direction opposite to the direction B, the nozzle 51 is released from the container 20. At this instant, the inside shutter 60 closes and surely prevents the toner from leaking. Further, when the toner container 20 is set in the mount portion 50, the inside shutter 60 is not positioned above the opening 56, but is positioned at the side of the opening 56. The inside shutter 60 therefore does not obstruct the delivery of the toner from the toner container 20 and prevents the toner from bridging inside the container 20. In addition, a minimum of toner is left in the toner container 20.

Another alternative embodiment will be described with reference to FIG. 11. As shown, the toner container 20 includes an outside shutter 160 in place of the inside shutter 60. The outside shutter 160 is made up of a shutter member 161 movable up and down and a spring 162 constantly biasing the shutter member 161 such that the shutter member 161 tends to close the toner outlet 24. A seal member 163 is fitted on the surface of the shutter member 161 that faces the mouth member 23.

Figure 11:
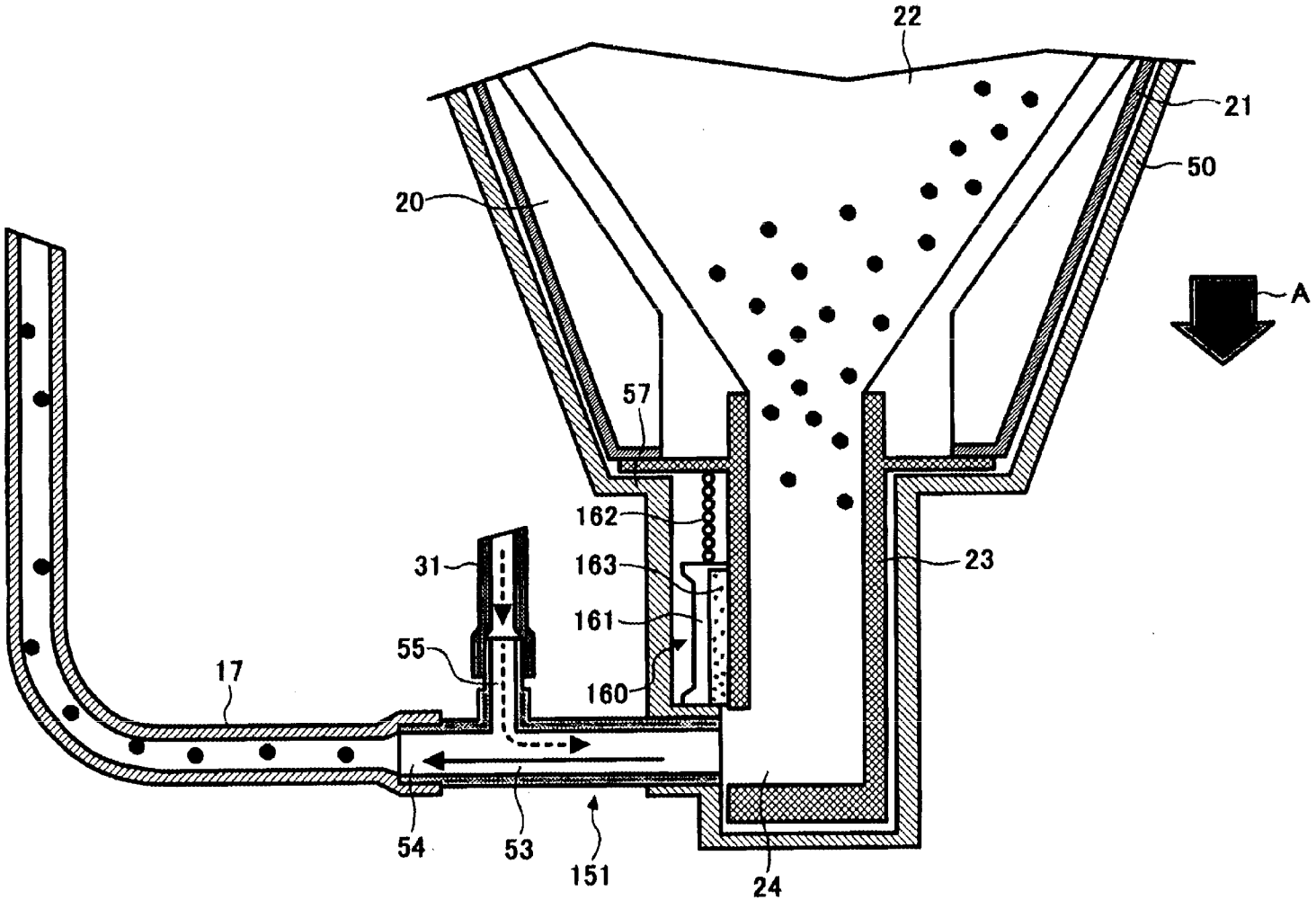
FIG. 11 is a fragmentary section showing another alternative embodiment of the present invention.

In the illustrative embodiment, the toner container 20 is mounted to the mount portion 50 from substantially right above the mount portion 50, as indicated by an arrow A in FIG. 11 (direction of gravity). At this instant, a lug 57 protruding from the mount portion 50 causes the shutter member 161 to move against the action of the spring 162 to a position where the shutter member 161 opens the toner outlet 24, as shown in FIG. 11. As a result, the toner outlet 24 is communicated to a conduit 151 included in the mount portion 50, making the toner container 20 ready to replenish the toner. When the toner container 20 is picked up, the shutter member 161 again closes the toner outlet 24 via the seal 163 due to the action of the spring 162. This is also successful to prevent the toner from dropping when the toner container 20 is removed from the mount portion 50.

The toner container 20 of the type shown in FIG. 11 is not configured such that the nozzle 51 penetrates into the container 20. The end of the conduit 151 and that of the mouth member 23 must therefore be hermetically sealed, but such sealing cannot be easily done because the above two ends are connected in the direction perpendicular to the direction in which the toner container 20 is mounted or dismounted. If the toner passage is not hermetically sealed, then in the configuration of FIG. 3 not only the toner leaks, but also the suction pressure for conveying the toner is likely to be practically lost. In this respect, the toner container 20 shown in FIG. 11 may be further devised to insure hermetic sealing.

Further, the nozzle 51 has a single wall with the air inlet joining the toner passage. While this type of nozzle 51 is simple and low cost, air is apt to flow not only toward the toner container 20 but also toward the downstream side in the direction of toner conveyance, causing the toner to stop up the tube 17.

Figure 12:
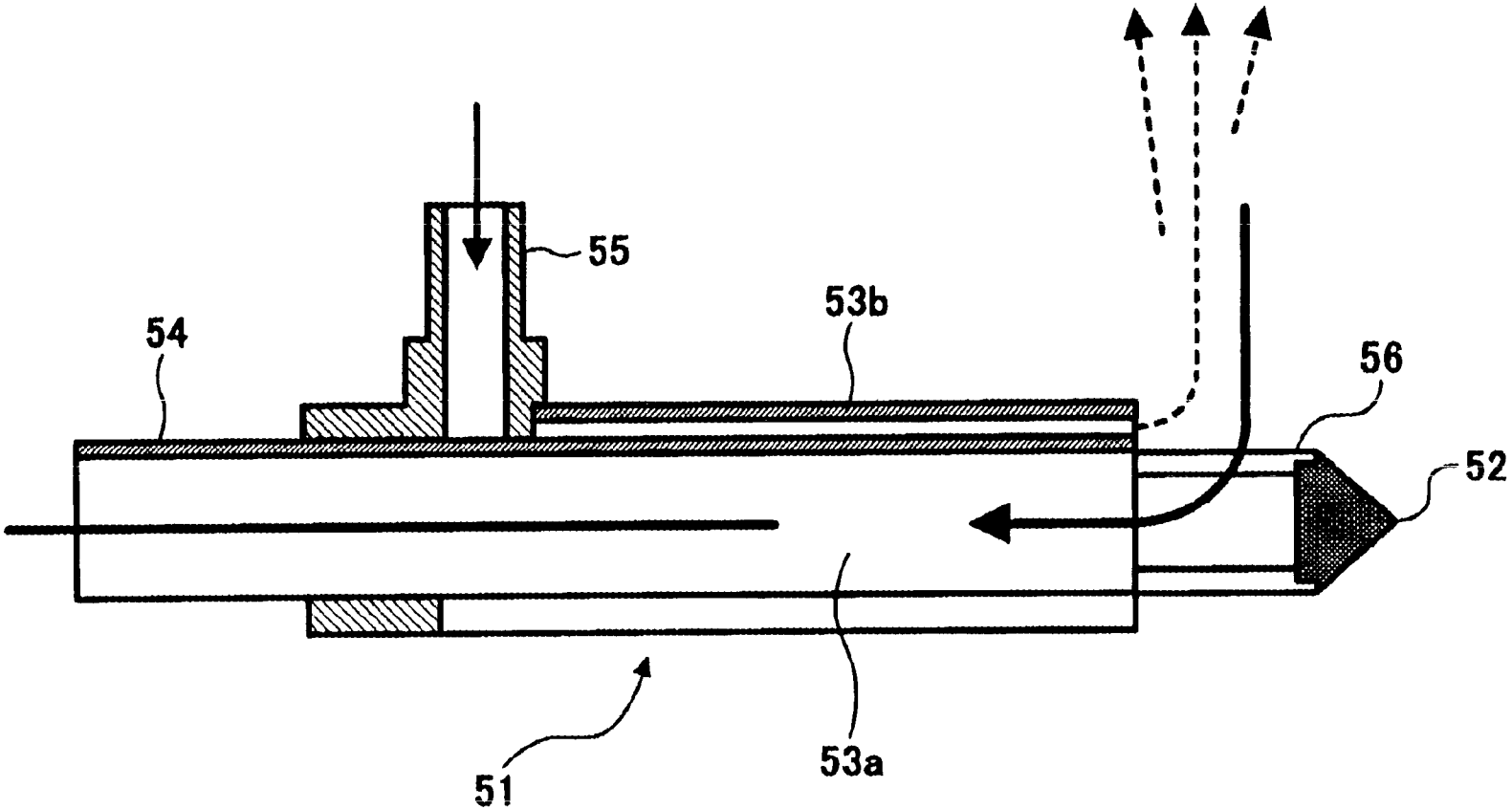
FIG. 12 is a section showing a preferred configuration of a nozzle applicable to any one of the illustrative embodiments.

In light of the above, as shown in FIG. 12, the nozzle 51 should preferably be provided with a double-wall structure in which a toner passage 53*a* and an air passage 53*b* are isolated from each other. Although the double-wall type nozzle 51 is more sophisticated and costly than the single-wall type nozzle 51, air is fed only to the toner container 20 and does not cause the toner to stop up the tube 17 at all.

Figure 13:
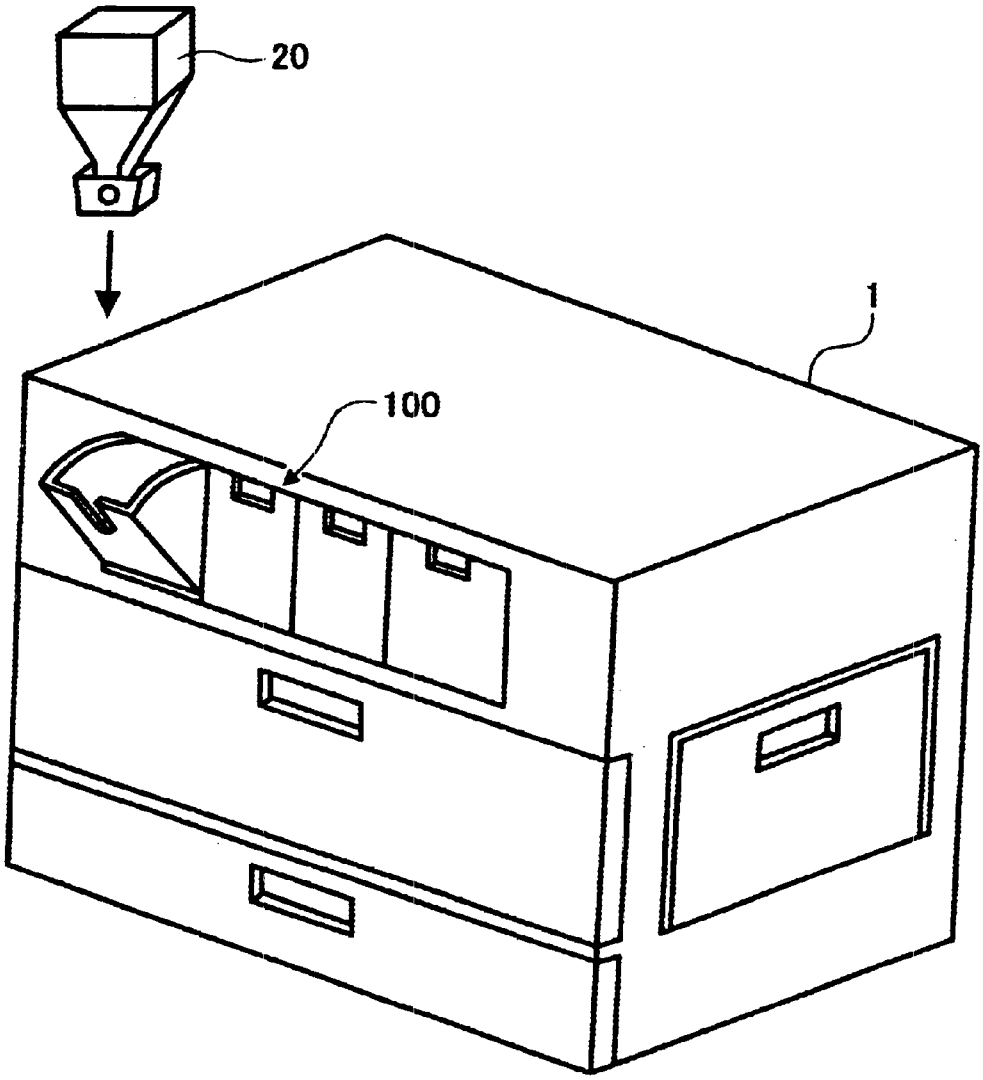
FIG. 13 is an external view showing an image forming apparatus to which any one of the illustrative embodiments is applicable.

FIG. 13 shows another specific configuration of the mount portion included in an image forming apparatus 1 for setting the toner container 20. As shown, the image forming apparatus 1 includes four mount portions 100 configured to receive one of four toner containers 20, each stores toner of particular color, in the direction of gravity. While the mount portion 100 assigned to black is shown as being greater in width than the other mount portions 100, all the mount portions 100 are identical in internal arrangement.

Figure 14:
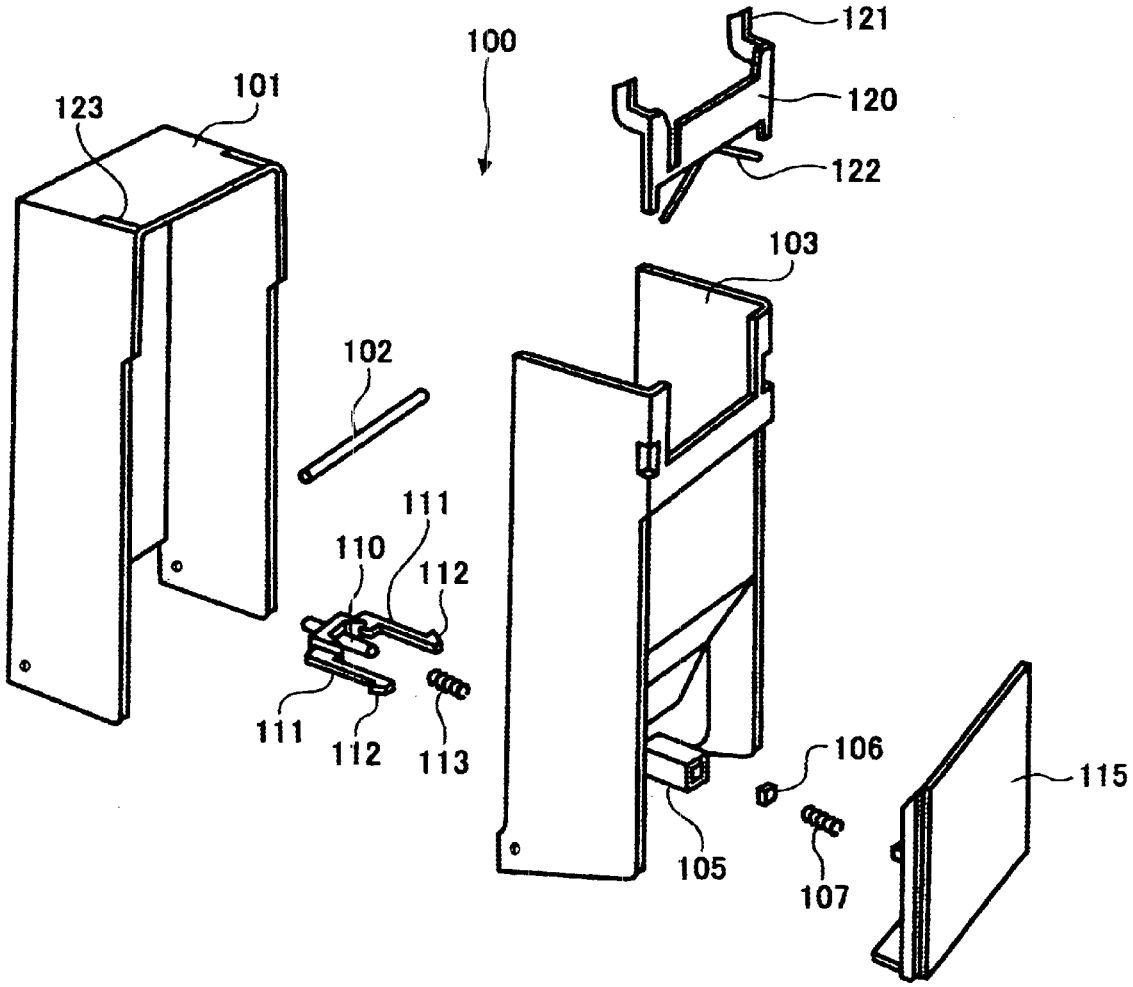
FIG. 14 is an exploded perspective view of a mount portion included in the apparatus of FIG. 13.

As shown in FIG. 14, each mount portion 100 includes an openable folder 103 mounted on a frame 101 via a shaft 102. The folder 103 is rotatable between a closed position shown in FIG. 15 and an open position shown in FIG. 16. A pair of guide members 104 are positioned in the lower portion of the folder 103 and slidably support a nozzle 110. A slider 106 is slidably received in a guide tube 105, which is also positioned in the lower portion of the folder 103 and serves to return the nozzle 110 inserted. A cover 115 is affixed to the outer surface of the folder 103.

A knob 120 formed of resin is positioned in the upper portion of the folder 103 in such a manner as to be movable in the up-and-down direction. A pair of locking members 121 protrude from the knob 120 for locking the folder 103 in the closed position. An elastic arm 122 is formed integrally with the knob 120 and constantly biases the knob 120 in the uppermost position. The nozzle 110 has the same diameter as a shutter member 81 included in the mouth member 80 of the toner container 20.

A pair of guide arms 111 extend out from opposite ends of the nozzle 110 and slidably supported by the guide members 104. More specifically, hooks 112 protrude from the ends of the slide arms 111 and are locked by the ends of the guide members 104, so that the nozzle 110 is prevented from being released from the folder 103. A coil spring 113 is loosely fitted around the nozzle 110 and positioned between the nozzle 110 and the folder 103. The coil spring 113 constantly biases the nozzle 110 in the direction in which the hooks 112 are locked by the ends of the guide members 104.

The guide tube 105 whose axis is aligned with the axis of the nozzle 110 is formed with a hole 105*a* at its end facing the nozzle 110. The shutter member 81 of the mouth member 80 is capable of entering the guide tube 105 via the hole 105*a*. The other end of the guide tube 105 is closed by the cover 115. The slider 106 and a coil spring 107 constantly biasing the slider 106 toward the nozzle 110 are received in the guide tube 105. The slider 106 has a stepped cross-section such that it is retained within the guide tube 105 by a stop 108, which is formed at the end of the guide tube 105 facing the nozzle 110, despite the bias of the coil spring 107. The folder 103 additionally includes a guide frame 109 for guiding the toner container 20 inserted in the folder 103 toward a set position. The nozzle 110 is positioned at the lowest position of the guide frame 109 and configured to receive the bottom of the mouth member 81 of the toner container 20. An opening, not shown, is formed in the mouth-receiving portion of the nozzle 110 and allows the nozzle 110 and shutter member 81 to pass therethrough.

When the operator grips the knob 120 and pulls the mount portion 100 downward toward the operator, the locking members 121 are released from slits 123 formed in the frame 101. The operator can therefore rotate the folder 103 about the shaft 102 to the open position until the bottom of the folder 103 abuts against the frame 101. In the open position of the folder 103, the nozzle 110 is retracted rightward, as viewed in FIG. 16. In this condition, the nozzle 110 is held in the position where the hooks 112 thereof are engaged with the guide members 104 by the coil spring 113. Therefore, when operator drops the toner container 20 into the mount portion 100 with the mouth member 80 facing downward, the shutter member 81 of the mouth member 81 drops to a position where it faces the nozzle 110.

Figure 15:
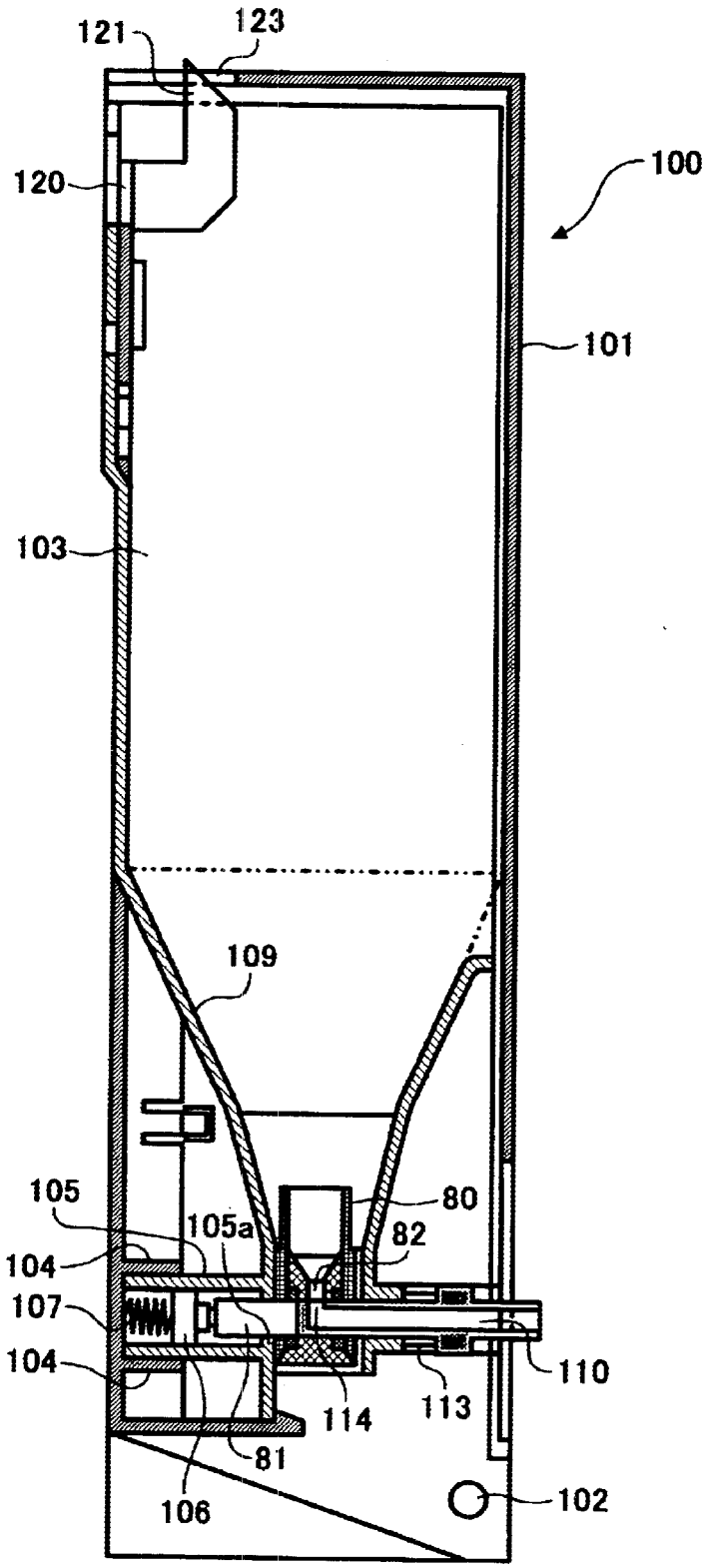
FIG. 15 is a section showing a folder included in the mount portion of FIG. 14 in a closed position.
Figure 16:
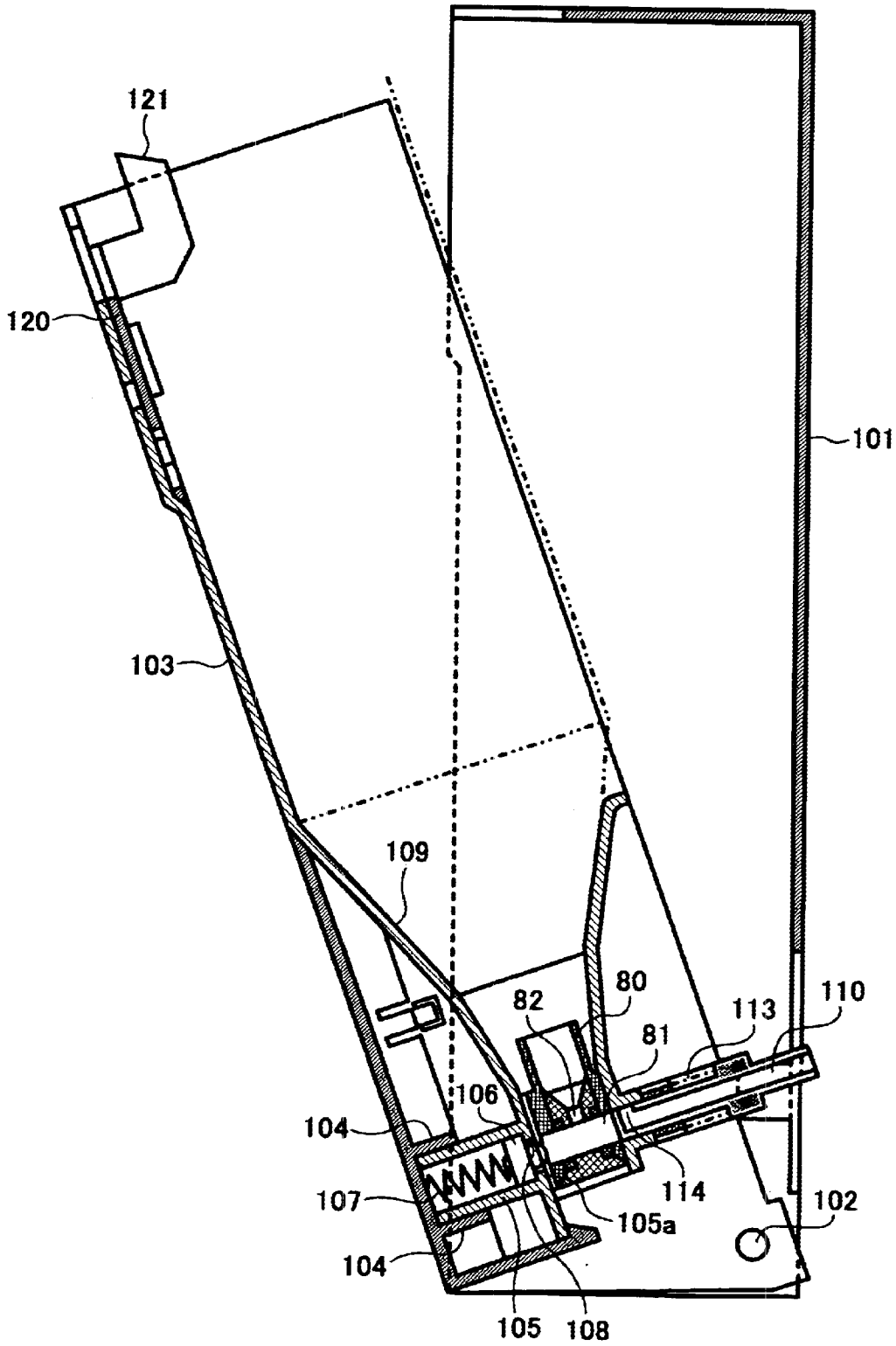
FIG. 16 is a section showing the folder in an open position.

Subsequently, the operator again closes the folder 103 to the position shown in FIG. 15. This causes the nozzle 110 to enter the shutter bore, pushing the shutter member 81 toward the guide tube 105 away from the shutter bore. A toner inlet 114, which is formed in part of the top of the nozzle 110 adjoining the end, is brought into communication with a hole 82 formed in the mouth member 80, so that a toner passage is set up from the toner container 20 to a developing device not shown. It is to be noted that when the shutter member 81 pushed by the nozzle 110 toward the guide member 105 does not fully get out of the shutter bore, but extends over both of the shutter bore and the guide tube 105.

When the nozzle 110 enters the shutter bore, the folder 103 compresses the coil spring 113 while the shutter member 81 compresses the coil spring 107 via the slider 106. Therefore, when the operator opens the folder 103, the nozzle 110 and shutter member 81 are returned to their original positions by the coil springs 113 and 107, respectively. Consequently, the nozzle 110 gets out of the shutter bore of the toner container 20 while the shutter member 81 again enters the shutter bore.

As stated above, only if the operator sets the toner container 20 in the mount portion 100, the container 20 is automatically brought into communication with the passage for toner replenishment. Moreover, when the operator opens the folder 103, the shutter member 81 immediately returns to the shutter bore although the nozzle 110 gets out of the shutter bore, preventing the toner from leaking from the toner container 20.

While the illustrative embodiments have concentrated on a toner replenishing device, the present invention is, of course, similarly applicable to a carrier or a toner and carrier mixture.

In summary, it will be seen that the present invention provides a developer container for an image forming apparatus having various unprecedented advantages, as enumerated below.

(1) The developer container includes a developer outlet formed in its side wall and shutter means. The shutter means opens the developer outlet when the toner container is mounted to the body of an image forming apparatus or closes it when the former is dismounted from the latter. Because the toner outlet is not open in the direction of gravity, toner is prevented from dropping from the toner container when the container is dismounted from the apparatus body.

(2) The toner container is mounted to the apparatus body in the direction of gravity while the developer outlet is open in substantially the horizontal direction. This also prevents the toner from leaking when the container is removed from the apparatus body. This is also true when a nozzle penetrates into or out of the toner container in the horizontal direction.

(3) The shutter means is implemented as a seal member formed of sponge and formed with a cruciform slit. Therefore, even if the slit does not immediately close when the toner container is released from the nozzle, scarcely any developer is caused to drop via the toner outlet.

(4) The shutter member includes a seal member movable between a closed position and an open position and a biasing member constantly biasing the seal member toward the closed position. When the developer container is mounted to the apparatus body, the seal member is moved from the closed position to the open position against the action of the biasing member. When the developer container is dismounted from the apparatus body, the seal member immediately returns to the closed position due to the action of the biasing member, thereby obviating the leak of the developer.

(5) The shutter means includes a shutter member constantly biased by a biasing member from the inside toward the outside of the developer container and movable between a closed position where it blocks a passage and an open position where it unblocks the passage, and a seal member disposed in the passage and slidable on the shutter member held in the closed position. When the developer container is mounted to the apparatus body, a nozzle moves the shutter member from the closed position to the open position in substantially the horizontal direction against the action of the biasing member. The shutter member therefore does not obstruct the delivery of the developer from the toner container, insuring stable developer replenishment.

(6) An image forming apparatus with the advantages described above is also achievable.

Various modifications will become possible for those skilled in the art after receiving the teachings of the present disclosure without departing from the scope thereof.

What is claimed is:

1. A developer container configured to be removably mounted to a body of an image forming apparatus, said developer container comprising:

a developer outlet formed in a side wall of said developer container; and shutter means for selectively opening or closing said developer outlet;

wherein said shutter means opens said developer outlet when said developer container is mounted to said body or closes said developer outlet when said developer container is dismounted from said body, and wherein said developer container is mounted to or dismounted from said body in substantially a direction of gravity, said developer outlet being open in a substantially horizontal direction.

2. The developer container as claimed in claim 1, wherein a nozzle mounted on said body is inserted into or removed from said developer outlet in a substantially horizontal direction when said developer container is mounted to or dismounted from said body, respectively.

3. The developer container as claimed in claim 2, wherein said shutter means comprises a seal member formed of foam sponge and closing said developer outlet, said shutter means being formed with a slit via which said nozzle is capable of penetrating into said developer container.

4. The developer container as claimed in claim 1, wherein said shutter means comprises:

an external shutter positioned outside of said developer outlet and movable between a closing position for closing said developer outlet and an opening position for opening said developer outlet; and a biasing member constantly biasing said external shutter toward the closing position;

wherein when said developer container is mounted to said body, said external shutter is moved from the closing position to the opening position against an action of said biasing member.

5. The developer container as claimed in claim 2, wherein said shutter means comprises:

a biasing member;

a shutter member constantly biased by said biasing member from an inside toward an outside of said developer container and movable between a closing position for closing a passage and an opening position for opening said passage; and a seal member disposed in said passage and slidable on said shutter member held in the closing position;

wherein when said developer container is mounted to said body, said nozzle penetrates into said developer container in a substantially horizontal direction while moving said shutter member from the closing position to the opening position against an action of said biasing member.

6. The developer container as claimed in claim 1, wherein a nozzle mounted on said body is inserted into or removed from said developer outlet in a substantially horizontal direction when said developer container is mounted to or dismounted from said body, respectively.

7. An image forming apparatus comprising:

a developer container removably mounted to said image forming apparatus and storing a developer;

air feeding means for feeding air under pressure into said developer container; and a substantially hermetically sealed passage extending from said developer container to a position to which the developer should be replenished;

said developer container comprising:

a developer outlet formed in a side wall of said developer container; and shutter means for selectively opening or closing said developer outlet;

wherein said shutter means opens said developer outlet when said developer container is mounted to said image forming apparatus or closes said developer outlet when said developer container is dismounted from said image forming apparatus, and wherein said developer container is mounted to or dismounted from said image forming apparatus in substantially a direction of gravity, said developer outlet being open in a substantially horizontal direction.

* * * * *